US005613856A

United States Patent [19]

Hoover

[11] Patent Number: 5,613,856

[45] Date of Patent: Mar. 25, 1997

[54] SKI TRAINING SYSTEM

[76] Inventor: Robert Hoover, 9280 SE. Orient Dr., Boring, Oreg. 97009

[21] Appl. No.: 501,167

[22] Filed: Jul. 11, 1995

[51] Int. Cl.[6] ..... A63B 69/18

[52] U.S. Cl. ..... 434/253; 482/71

[58] Field of Search ..... 434/253; 482/54, 482/71, 74, 70

[56] References Cited

U.S. PATENT DOCUMENTS

| | | | |
|---|---|---|---|
| 937,795 | 10/1909 | Hackney | 482/54 |
| 3,207,510 | 9/1965 | Gibson | 482/71 |
| 3,408,067 | 10/1968 | Armstrong | 434/253 |
| 3,554,541 | 1/1971 | Seaman | 482/54 |
| 3,641,601 | 2/1972 | Sieg | 482/54 |
| 3,689,066 | 9/1972 | Hagen | 482/54 |
| 3,831,935 | 8/1974 | Hofle | 482/71 |
| 3,929,329 | 12/1975 | Rivera | 482/71 |
| 4,659,845 | 5/1972 | Quinton | 482/54 |
| 4,993,704 | 2/1991 | Luczynski | 482/71 |
| 5,326,338 | 7/1994 | Makous | 434/253 |

*Primary Examiner*—Paul J. Hirsch

*Attorney, Agent, or Firm*—Klarquist Sparkman Campbell Leigh & Whinston, LLP

[57] ABSTRACT

A device allows a person to practice ski turns, while wearing his or her own skis, and to make the body movements required for turning. The device includes a base unit and an elevated support surface.

13 Claims, 2 Drawing Sheets

SKI TRAINING SYSTEM

BACKGROUND OF THE INVENTION

The present invention relates to exercise devices and, in particular, to devices for training skiers in the absence of snow.

A variety of devices are used for ski training and exercising when it is inconvenient to travel to a location where there is suitable snow for skiing. Such devices include artificial ski slopes having plastic surfaces. These are typically quite large devices that extend to a substantial height above the floor and have a large foot print. Some such devices have moving treadmill-type surfaces. Such devices are not suitable for use in a confined area such as a home.

There are also mechanical exercise devices which are constructed so that the user moves his or her limbs in the manner of a cross-country skier. These devices tend to be mechanically complex and do not allow the user to practice the body movements required for making skiing turns.

SUMMARY OF THE INVENTION

The present invention is a device for practice skiing. The device allows the user to practice while wearing his or her own skis and to make the body movements required for turning. The device, which includes a base unit and an elevated support surface, is compact and can be used in a confined area.

DETAILED DESCRIPTION

The present invention is an apparatus for ski training. Several embodiments are shown in the accompanying drawings.

Figure 1:
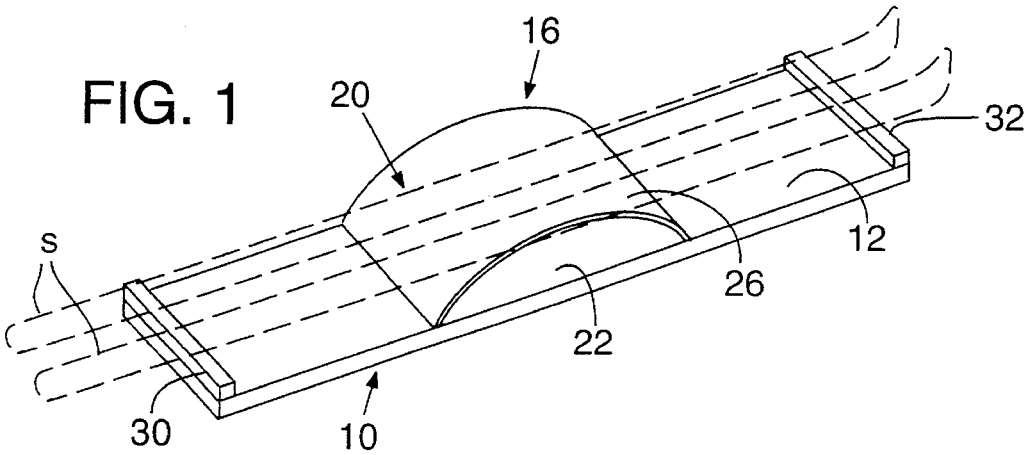
FIG. 1 is an oblique view of a ski training system according to the present invention.
Figure 2:
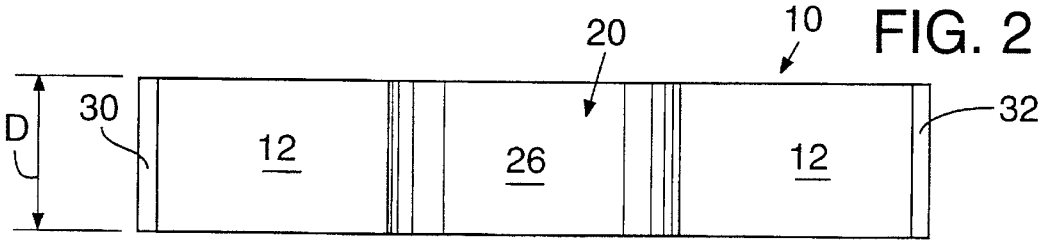
FIG. 2 is a top plan view of the system shown in FIG. 1.
Figure 3:
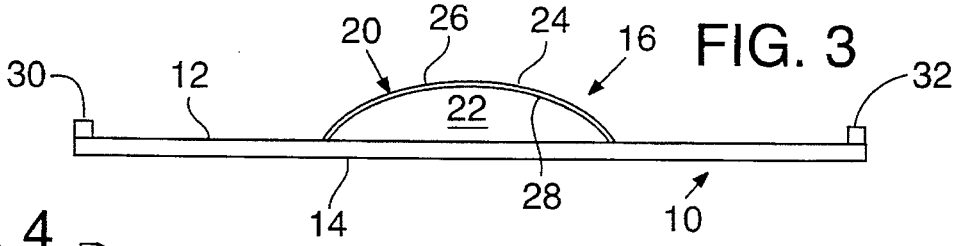
FIG. 3 is a front elevational view of the system shown in FIG. 1.

FIGS. 1–3 illustrate a basic embodiment of the invention. A base unit 10 has upper and lower surfaces 12, 14. The base unit rests on its bottom face 14.

An elevated support surface 16 extends upwardly from the base unit 10. The support surface 16 is constructed to be sufficiently wide in a horizontal dimension D to support two skis S being worn by a person using the apparatus. The dimension D, measured perpendicular to the longitudinal axis of the skis is preferably at least two feet.

In the embodiment of FIGS. 1–3, the support surface 16 is arch shaped. The surface is constructed from a sheet 20 of fabric which is secured over an arch shaped support body 22. The body 22 has an upper surface 24 that supports the sheet 20. The sheet 20 has an upper surface 26 which provides the support surface and a lower surface 28 which rests on the upper surface 24 of the body 22. The body 22 may be constructed of a rigid material such as plywood, metal, or rigid plastic. Alternatively, for cushioning effect, the body 22 can be made from a resilient material such as high-density closed cell foam.

A sheet 20 can be made of a number of different materials depending upon the desired effect. Conveniently, the sheet can be made of carpeting, rubber or some other resilient polymer material. Alternatively, the apparatus can be constructed without a sheet 20 of fabric. In that case, the upper surface 24 of the body 22 would provide the support surface. If the sheet 20 of fabric is omitted, the body 22 will preferably be constructed of a polymeric material. In any event, it is preferred that the material which provides the support surface 16 have a sufficiently high coefficient of friction that the user's skis will not readily slide off.

In the illustrated embodiment, two rails 30, 32 are provided on the base unit 10 on opposite sides of the support surface 16. The rails provide support for the user if the skis become tipped too far forward or backward. The rails extend to an elevation that is less than the elevation of the upper surface 26. The rails are positioned to be generally perpendicular to and under the user's skis, near the tips and tails of the skis respectively, when the apparatus is in use.

Figure 4:
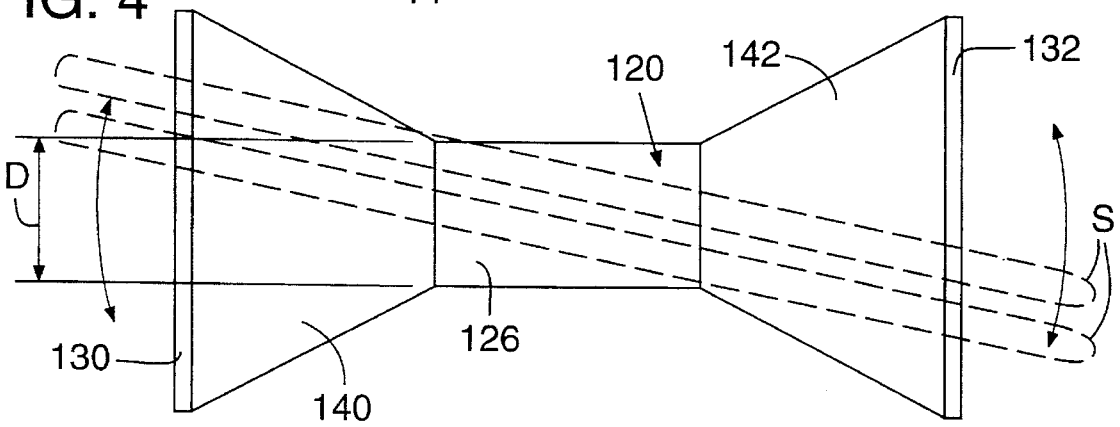
FIG. 4 is a top plan view of an alternate embodiment of the system shown in FIG. 1.
Figure 5:
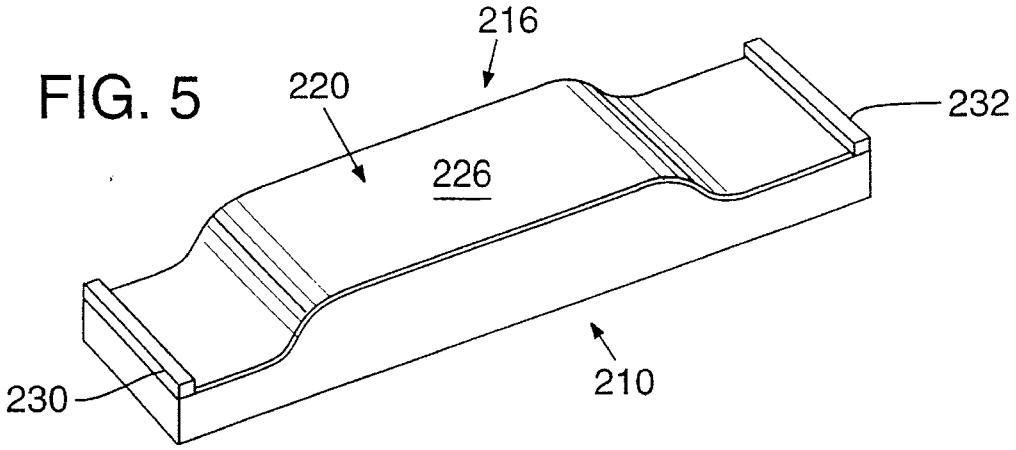
FIG. 5 is an oblique view of an alternate embodiment of the ski training system shown in FIG. 1.
Figure 6:
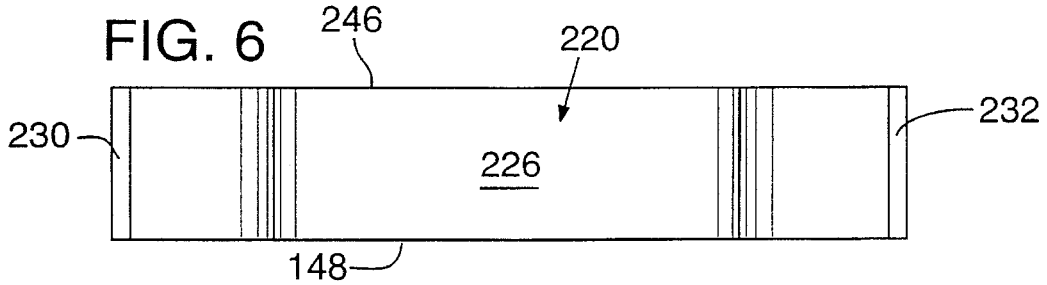
FIG. 6 is a top plan view of the system shown in FIG. 5.
Figure 7:
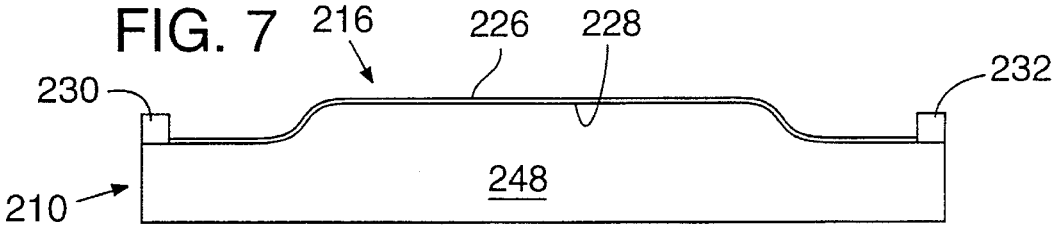
FIG. 7 is a front elevational view of the system shown in FIG. 5.

FIG. 4 illustrates an alternative embodiment of the apparatus shown in FIGS. 1 and 3. In FIG. 4, the reference numerals have been incremented by 100 where appropriate.

In the apparatus of FIG. 4, two portions 140, 142 of the base unit are flared outwardly from the region of the support surface 116 to stabilize the apparatus. In the illustrated embodiment, the portions 140, 142 appear as panels of a planar material such as plywood. It will be understood that other constructions could be used such as trapezoidal frames of metal tubes.

FIGS. 5–8 show a somewhat more complex embodiment of the invention. In this embodiment, a mechanism is provided to simulate motion. The reference numerals in FIGS. 5–8 correspond to numerals appearing in FIGS. 1–3, incremented by 200 where appropriate.

In this embodiment, a sheet 220 of flexible material is supported on a movable contact member that is located below and in contact with the lower surface 228. A driver is mounted on the base unit 210 and is connected to the contact member to move the contact member. In particular, in the embodiment of FIG. 8, the contact member is a belt mechanism that includes two rollers 242, 244 rotatably mounted between two sidewalls 246, 248 of the base unit 210. The rollers are spaced apart and have parallel axes 250, 252 of rotation. An endless belt 254 is supported by the rollers 242, 244. The belt 254 has an outer friction surface 256 that is in contact with the lower surface 288 of the sheet 220 of flexible material. The driver is an electric motor 258 which is drivingly attached to the roller 244 by a belt or a chain 260. The motor 258 is mounted to the side wall 246 of the base unit 210. The friction surface 256 of the belt 254 is textured in the illustrated embodiment. In particular, the surface includes a plurality of ridges 262 that contact the lower surface 228.

Figure 8:
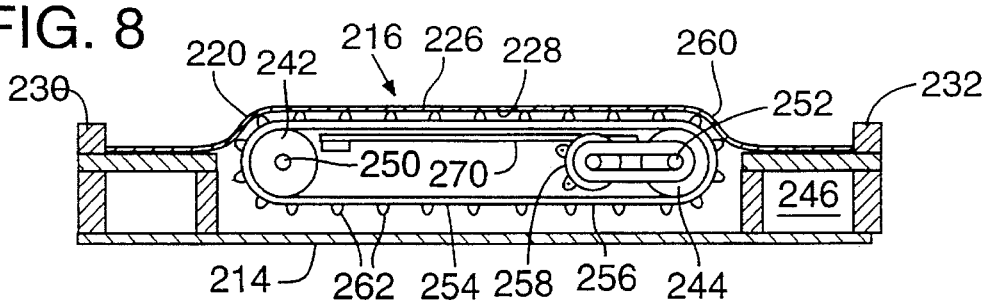
FIG. 8 is a sectional view taken along line 8—8 of FIG. 6 showing an internal mechanism for simulating motion.

To operate the apparatus of FIG. 8, a switch (not shown) is thrown to energize the motor 258. The motor causes the roller 244 to rotate and move the belt such that the friction surface 254 of the belt moves along the lower surface 228 of the sheet 220 of flexible material. The passing of the ridges 262 along the surface 228 causes the sheet material to undulate and simulate movement. A platen 270 may be mounted between the side walls 246, 248 if necessary to support the belt 254.

In the embodiment of FIGS. 5–8, the support surface 216 is substantially planar which simulates skiing on planar terrain. In comparison, the apparatus of FIGS. 1–3 has an arched surface 16 which more nearly approximates mogul skiing.

Figure 9:
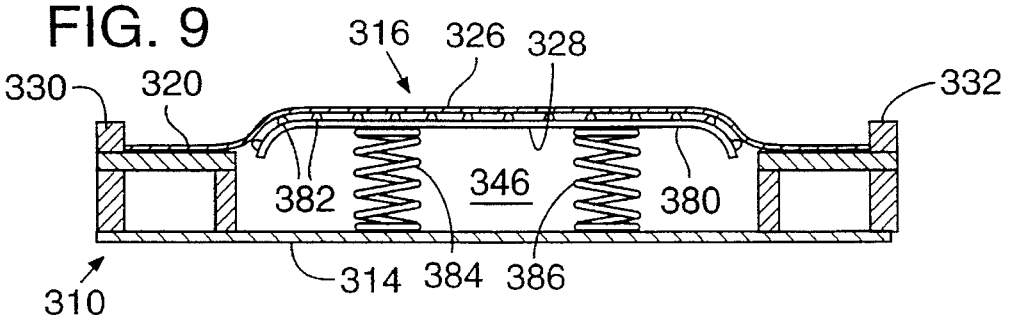
FIG. 9 is a sectional view taken along line 8—8 of FIG. 6 showing an alternative internal construction.

FIG. 9 shows yet another embodiment of the invention. The embodiment of FIG. 9 is substantially identical to the embodiment of FIGS. 5–8, except for internal structure. The reference numerals in FIG. 9 are incremented, where appropriate, by 300 from those shown in FIGS. 1–3.

The apparatus of FIG. 9 includes a support platen 380 located below the sheet 320. The platen has an upper surface that optionally includes a plurality of ridges 382. The platen is free floating, supported by coil springs 384, 386 or some other resilient support. Because the sheet 320 is resiliently supported, the user feels more natural impacts when making turning movements on the support surface 316.

All of the illustrated embodiments are used in substantially the same manner. A skier wears normal skis and stands on the support surface. Parallel turns can then be practiced. Normal parallel skiing style is used with the skis being turned from left to right, and vice versa, as illustrated by arrows in FIG. 4. To provide balance, the user may hold ski poles. Extra long or extended ski poles may be required to compensate for the elevation of the support surface.

While the invention has been described in connection with preferred embodiments and variations thereof, it will be understood that the invention is intended to comprehend all alternatives, modifications, and equivalents as may be included within the spirit and scope of the invention as defined by the appended claims.

I claim:

1. A ski training apparatus comprising a base unit having a bottom face on which the base unit rests and an elevated support surface that is sufficiently wide in a horizontal dimension to support two skis being worn by a person using the apparatus, the support surface being constructed to support the person in such a manner that the person can tip the skis forward and backward and can turn the skis from left to right, and vice versa, so that the person can practice making parallel ski turns the support surface having a elevated surface out of plane with its ends.

2. The apparatus of claim 1 wherein the support surface is arch-shaped.

3. The apparatus of claim 1 wherein the support surface is planar.

4. The apparatus of claim 1 further comprising a sheet of fabric that provides the support surface.

5. The apparatus of claim 1 further comprising a body of a polymeric material, the body having an upper surface that provides the support surface.

6. The apparatus of claim 1 further comprising:

a sheet of flexible material having an upper surface and a lower surface, the upper surface providing the support surface;

a movable contact member located below and in contact with the lower surface; and a driver that is mounted on the base unit and that is connected to the contact member to move the contact member.

7. The apparatus of claim 6 wherein:

the contact member comprises a belt mechanism having (a) at least two rollers rotatably mounted on the base, the rollers being spaced apart and having parallel axes of rotation and (b) an endless belt supported by the rollers, the belt having a friction surface in contact with the lower surface of the sheet of flexible material; and the driver comprises a motor in driving attachment to at least one of the rollers so that operation of the motor causes at least one of the rollers to rotate and move the belt such that the friction surface of the belt moves along the lower surface of the sheet of flexible material.

8. The apparatus of claim 7 wherein the friction surface is textured such that movement of the friction surface along the lower surface causes the upper surface of the sheet of flexible material to undulate when the motor is operated.

9. The apparatus of claim 1 wherein at least one portion of the bottom face flares outwardly from the region of the support surface to stabilize the apparatus.

10. The apparatus of claim 1 further comprising two rails connected to the base unit, the rails being positioned to be perpendicular to and under the person's skis, near the tips and tails of the skis respectively, when the apparatus is in use.

11. The apparatus of claim 1 wherein the support surface is at least two feet wide as measured perpendicular to the longitudinal axes of the skis.

12. A ski training apparatus comprising a base unit having a bottom face on which the base unit rests and a sheet of flexible material having an upper surface and a lower surface, the upper surface providing an elevated support surface that is sufficiently wide in a horizontal dimension to support two skis being worn by a person using the apparatus;

a movable contact member located below and in contact with the lower surface, the contact member comprising a belt mechanism having (a) at least two rollers rotatably mounted on the base, the rollers being spaced apart and having parallel axes of rotation and (b) an endless belt supported by the rollers, the belt having a friction surface in contact with the lower surface of the sheet of flexible material; and a driver that is mounted on the base unit and that is connected to the contact member to move the contact member, the driver comprising a motor in driving attachment to at least one of the rollers so that operation of the motor causes at least one of the rollers to rotate and move the belt such that the friction surface of the belt moves along the lower surface of the sheet of flexible material.

13. The apparatus of claim 12 wherein the friction surface is textured such that movement of the friction surface along the lower surface causes the upper surface of the sheet of flexible material to undulate when the motor is operated.

* * * * *